US007413704B2

(12) United States Patent
Matsuzaki et al.

(10) Patent No.: US 7,413,704 B2
(45) Date of Patent: Aug. 19, 2008

(54) CASE HARDENING BEARING STEEL HAVING EXCELLENT TOUGHNESS AND ROLLING CONTACT FATIGUE LIFE IN INTERMEDIATE TEMPERATURE

(75) Inventors: Akihiro Matsuzaki, Chiyoda-ku (JP); Takashi Iwamoto, Chiyoda-ku (JP); Masao Goto, Osaka (JP); Katsuhiko Kizawa, Osaka (JP)

(73) Assignees: JFE Steel Corporation (JP); Koyo Seiko Co., Ltd. (JP)

( * ) Notice: Subject to any disclaimer, the term of this patent is extended or adjusted under 35 U.S.C. 154(b) by 0 days.

(21) Appl. No.: 10/502,691

(22) PCT Filed: Apr. 9, 2003

(86) PCT No.: PCT/JP03/04527

§ 371 (c)(1),
(2), (4) Date: Jul. 27, 2004

(87) PCT Pub. No.: WO03/087421

PCT Pub. Date: Oct. 23, 2003

(65) Prior Publication Data

US 2005/0081962 A1 Apr. 21, 2005

(30) Foreign Application Priority Data

Apr. 18, 2002 (JP) ..... 2002-116065

(51) Int. Cl.
*C22C 38/18* (2006.01)
*C22C 38/22* (2006.01)
*C22C 38/38* (2006.01)
*C23C 8/22* (2006.01)

(52) U.S. Cl. ..... 420/105; 148/319; 148/906

(58) Field of Classification Search ..... 420/105; 148/319, 906
See application file for complete search history.

(56) References Cited

U.S. PATENT DOCUMENTS 5,298,323 A 3/1994 Narai et al.
5,698,159 A * 12/1997 Ochi et al. ..... 420/104

FOREIGN PATENT DOCUMENTS

JP 04-032537 * 2/1992
JP 04-32537 * 2/1992
JP 5-132713 A 5/1993
JP 5-132713 A * 5/1993
JP 6-145897 A 5/1994
JP 6-145897 A * 5/1994

OTHER PUBLICATIONS

Davis et al., ASM Handbook, 1995 International, vol. 4, pp. 312-315.*

* cited by examiner

*Primary Examiner*—John P. Sheehan
*Assistant Examiner*—Jessee Roe
(74) *Attorney, Agent, or Firm*—DLA Piper US LLP

(57) ABSTRACT

A case hardening bearing steel having an excellent rolling contact fatigue life in intermediate temperature, in addition, excellent toughness at room temperature is provided. Specific means for solving the problems are as follows. The composition contains, by mass percent, C of 0.15 to 0.30 mass percent, Si of 0.5 to 2.0 mass percent, Mn of 0.3 to 2.0 mass percent, Cr of 1.3 to 2.5 mass percent, Mo of 0.3 to 1.0 mass percent, and O of not more than 0.0012 mass percent in a range where (Si+Mo)≧1.0 mass percent is satisfied, and contains iron and inevitable impurities as remnant; the maximum size of oxide nonmetallic inclusion is not more than 12.5 μm when examined area is 320 $mm^2$; number of the oxide nonmetallic inclusion having a diameter of equivalent circle of 3 μm or more is not more than 250 when the examined area is 320 $mm^2$; in addition, C density of an outer layer is adjusted to be in a range from 0.7 to 1.2 mass percent by carburization.

4 Claims, No Drawings

CASE HARDENING BEARING STEEL HAVING EXCELLENT TOUGHNESS AND ROLLING CONTACT FATIGUE LIFE IN INTERMEDIATE TEMPERATURE

TECHNICAL FIELD

This disclosure relates to a case hardening bearing steel for use in a ball-and-roller bearing such as roller bearing or ball bearing.

Particularly, the disclosure relates to a case hardening bearing steel that can show an excellent rolling contact fatigue life characteristic and has excellent toughness, even if the steel is used in a temperature range from 150° C. to 250° C. (hereinafter, referred to as "intermediate temperature") appropriately answering to increased severity of the environment of the bearing, in particular, rise of temperature to be used with increase of operation speed or bearing force.

BACKGROUND ART

Heat-resistant bearing material for use in the ball-and-roller bearing is required to have a long rolling contact fatigue life. For this purpose, for example, in JP-B-54-41014, improvement of the characteristic at normal and high temperatures is designed by adding a large amount of element that forms carbides. JP-A-3-253542, focusing on retardation of softening during tempering, proposes a steel in which Si or Mo content is increased. However, when a bearing steel of which the toughness is originally low is added with such element, the toughness is further deteriorated. There has been limitation or various restrictions in use.

Alternatively, JP-A-63-60257 proposes a carburized steel having improved pitting resistant or durability by reducing certain components in a composition, in particular, S and O. However, again in this steel, the stable rolling contact fatigue life has not always been achieved in the intermediate temperature.

DISCLOSURE OF THE INVENTION

Summary

We provide a case hardening bearing steel having an excellent rolling contact fatigue life in the intermediate temperature, in addition, excellent toughness at the normal temperature.

We investigated the effects of alloy elements on the rolling contact fatigue life of case hardening steel in the intermediate temperature. In the case hardening steel, since only the layer about 1 mm deep from a surface is a high carbon content region and thus hardened, the stress condition during the rolling contact fatigue is different from that in the high carbon bearing steel. Therefore, it is considered that structural change during the rolling contact fatigue and effects of the alloy elements on the structural change in the case hardening bearing steel are different from those in the high carbon bearing steel.

Thus, we investigated effects of the alloy elements with respect to the point, and found that increase of the Si or Mo content was effective.

Moreover, it was found that the rolling contact fatigue life in the intermediate temperature was not only dominated by metal structure, but affected strongly by existence of oxide metallic inclusions. Particularly, it was newly found that control of size and number of the oxide metallic inclusion was extremely effective for improving the rolling contact fatigue life in the intermediate temperature.

Furthermore, we investigated a method for improving the toughness of such high-alloy type bearing steel and, as a result, it was found that C content within the steel is decreased, and only the outer layer is adjusted to have an appropriate C density by carburization, thereby the excellent toughness can be secured together with the excellent rolling contact fatigue life in the intermediate temperature.

We provide case hardening bearing steel having the excellent toughness and rolling contact fatigue life in the intermediate temperature, which is characterized in that the steel has a composition containing, C of 0.15 to 0.30 mass percent,
Si of 0.5 to 2.0 mass percent,
Mn of 0.3 to 2.0 mass percent,
Cr of 1.3 to 2.5 mass percent,
Mo of 0.3 to 1.0 mass percent,
and 0 of not more than 0.0012 mass percent;
in a range satisfying (Si+Mo)≧1.0 mass percent, and containing iron and inevitable impurities as remnant; and the maximum size of the oxide nonmetallic inclusion is not more than 12.5 μm when examined area is 320 $mm^2$; number of the oxide nonmetallic inclusion having diameter of the equivalent circle of not less than 3 μm is not more than 250 when the examined area is 320 $mm^2$; in addition, the C density of the outer layer is adjusted in a range from 0.7 to 1.2 mass percent.

DETAILED DESCRIPTION

Hereinafter, the reason for limiting the composition of the steel within the above range is described.

C is an element that contributes to improvement of strength and the toughness of the steel by dissolving in matrix or forming carbides. The purpose of containing C is to secure the strength and toughness of a bearing member. However, when the C content is less than 0.15 mass percent, the adding effect is short, on the other hand, when the C content is more than 0.25 mass percent, the steel is hardened more than requires, in addition, the toughness is deteriorated, therefore C is limited within a range from 0.15 to 0.30 mass percent.

Si: 0.5 to 2.0 Mass Percent

Si is a useful element for improving the rolling contact fatigue life in the intermediate temperature by increasing the strength after quenching and tempering through dissolving in the matrix and increasing the retardation of softening during tempering. However, when the Si content is less than 0.5 mass percent, the adding effect is short, on the other hand, when the Si content is more than 2.0 mass percent, workability is deteriorated, therefore Si is limited within a range from 0.5 to 2.0 mass percent.

Mn: 0.3 to 2.0 Mass Percent

Mn acts effectively to improve toughness and hardness of martensite as the matrix and improve the rolling contact fatigue life by improving hardenability of the steel. To this end, at least 0.3 mass percent needs to be contained, however, excessive Mn content significantly deteriorates machinability, therefore Mn is limited within a range from 0.3 to 2.0 mass percent.

Cr: 1.3 to 2.5 Mass Percent

Cr is a useful component that effectively contributes to improving the hardenability, the strength, and wear resistance, and thus improves the rolling contact fatigue life. However, when the Cr content is less than 1.3 mass percent, the adding effect is short, on the other hand, when the content is more than 2.5 mass percent, the rolling contact fatigue life and the machinability are deteriorated, therefore Cr is limited within a range from 1.3 to 2.5 mass percent.

Mo: 0.3 to 1.0 Mass Percent

Mo effectively contributes as an element for improving the rolling contact fatigue life in the intermediate temperature by increasing the strength after the quenching and tempering through dissolving in the matrix and increasing the retardation of softening during tempering. However, when the Mo content is less than 0.3 mass percent, the adding effect is short, on the other hand, when the content is more than 1.0 mass percent, the workability is deteriorated, therefore Mo is limited within a range from 0.3 to 1.0 mass percent.

(Si+Mo)≧1.0 mass percent.

(Si+Mo)≧1.0 mass percent

To achieve the excellent hardness after the tempering at high temperature and the excellent rolling contact fatigue life in the intermediate temperature, Si and Mo are particularly important among the components, and to obtain the desired effects stably, it is essential to contain the elements not less than 1.0 mass percent in all. Accordingly, Si and Mo are limited within the range satisfying (Si+Mo)≧ 1.0 mass percent. O: not more than 0.0012 mass percent It is important to control the size and number of the oxide nonmetallic inclusions. To this end, it is preferable to reduce oxygen as the element forming the oxide non-metalic inclusion as much as possible. From this viewpoint, the oxygen is controlled to be 0.0012 mass percent or less.

Hereinabove, although the preferable composition range is described, it is also important to control the size and number of the oxide non-metalic inclusion formed in the steel together.

That is, we systematically investigated the size and number of the oxide non-metalic inclusion that inversely affected on the rolling contact fatigue life and toughness. As a result, it was found that the excellent rolling contact fatigue life was obtained in the intermediate temperature by controlling the size and number together.

That is, the maximum size of the oxide nonmetallic inclusion was controlled to be not more than 12.5 μm, and the number of the oxide nonmetallic inclusion having a diameter of the equivalent circle of 3 μm or more was controlled to be 250 or less when the examined area was 320 $mm^2$, thereby the excellent rolling contact fatigue life was able to be obtained in the intermediate temperature.

To control the size and number of the oxide nonmetallic inclusion within the above range, it is preferable that the oxygen content in the steel is controlled to be not more than 0.0012 mass percent, and then degassing time is prolonged during a vacuum degassing, particularly RH degassing, in production processes of the steel, thereby separation, refining, and floatation of the inclusion are accelerated.

Production processes other than the degassing are not particularly limited, and can be performed according to any of the conventionally known methods.

It is important that after producing the steel, C density of an outer layer of the steel is adjusted to be in a range from 0.7 to 1.2 mass percent by carburization.

By performing the carburization, the surface is hardened, in addition, residual compressive-stress is imparted, thereby the rolling contact fatigue life is improved. When the C density of the outer layer is less than 0.7 mass percent, the effects can not be obtained, on the other hand, when the C content is more than 1.2 mass percent, hardness is increased more than requires, causing deterioration of the life due to the structure change during the rolling contact fatigue. The C density of the outer layer is limited within a range from 0.7 to 1.2 mass percent.

Here, the outer layer is a range from the surface of the steel to a depth of 0.5 mm. To control the C density of the outer layer within the above range, the carburization can be performed in a condition of carbon potential from 0.7% to 1.2%.

EXAMPLE

After converter refining, the RH degassing was performed, and then a number of blooms having various compositions shown in Table 1 were produced by continuous casting. Next, the blooms were subjected to diffusion annealing at 1240° C. for 30 hrs, and then rolled into bar steel 65 mm in diameter. After that, the bar steel was subjected to softening annealing, then machined into forms of an impact test piece and a rolling contact fatigue test piece. In the above production processes, precipitation condition of the oxide nonmetallic inclusion was controlled by adjusting the degassing time in the RH degassing, and the degassing time was set to be longer in the examples than that in the conventional examples.

The impact test piece was made as a Charpy test piece 10 mm square with a circular notch having a radius of 20 mm (3 mm in depth), and the rolling contact fatigue test piece was made as a thrust type test piece.

In respective test pieces machined as the above, the conventional example (SUJ2), No. 1, was subjected to the quenching and tempering, and each of the examples and comparative examples was subjected to carburization quenching and tempering, then those were used for respective tests.

In evaluation of the rolling contact fatigue life, stress loading number to breakdown in the cumulative failure properbility of 10% (B10 life) was obtained assuming that test lubricant temperature in the thrust test was 150° C., and then the life was evaluated by a relative value when the life of the conventional example (SUJ2) was replaced by 1.

The results are shown in Table 1. Each of the examples Nos. 2, 3, 4, 5, and No. 14, in which the composition and inclusion condition meet the requirements, has extremely improved rolling contact fatigue life in the intermediate temperature compared with the conventional example, in addition to toughness of central portion.

On the other hand, in the comparative examples, Nos. 6 and 7 although the alloy composition meets the appropriate range, the O content and inclusion condition are out of the appropriate range. The rolling contact fatigue life is good compared with the conventional example but bad compared with the example, showing that sufficiently improved effects are not obtained.

In the comparative example, No. 8, since the C content is more than the upper limit, although the rolling contact fatigue life is improved compared with the conventional example, the hardness of the central portion is high and the toughness is significantly deteriorated.

In the comparative example, No. 9, since the C content is less than the lower limit, although the rolling contact fatigue life is improved compared with the conventional example, the hardness of the central portion is low and the strength is short.

In the comparative examples Nos. 10, 11 and 12, since the compositions are out of the appropriate range, satisfactorily improved effects of the rolling contact fatigue life are not obtained.

Each of the comparative examples, Nos. 13 and 15, which are steels having a same composition position as that of the example, No. 14, has a different C content of the outer layer after the carburization by changing the carburization conditions. In the comparative examples, Nos. 13 and 15, since the C content of the outer layer after the carburization is out of the appropriate range, although the toughness is good, the rolling contact fatigue life is significantly bad.

INDUSTRIAL APPLICABILITY

The case hardening bearing steel having the excellent rolling contact fatigue life in the intermediate temperature and toughness at normal temperature together can be stably provided, thereby a major contribution is made to the extension of the bearing life and improvement of safety.

TABLE 1

| | Composition (mass percent) | | | | | | | Oxide inclusion | | C quantity of | | | Rolling | |
|---|---|---|---|---|---|---|---|---|---|---|---|---|---|---|
| No. | C | Si | Mn | Cr | Mo | O | Si + Mo | Maximum size (μm) | number | cemented outer layer (mass percent) | Hardness of center Hv | Tough Ness*1 (J/cm□) | contact fatigue life*2 B10 | remarks |
| 1 | 1.00 | 0.25 | 0.42 | 1.48 | 0.00 | 0.0015 | 0.25 | 15.8 | 320 | No carburization | 740 | 32 | 1.0 | Conventional example |
| 2 | 0.22 | 0.98 | 0.53 | 1.95 | 0.47 | 0.0008 | 1.45 | 8.5 | 161 | 0.98 | 414 | 63 | 12.6 | Inventive example of n |
| 3 | 0.17 | 1.32 | 0.62 | 1.75 | 0.56 | 0.0010 | 1.88 | 8.1 | 132 | 1.02 | 365 | 58 | 11.5 | Inventive example |
| 4 | 0.17 | 1.10 | 0.54 | 1.88 | 0.48 | 0.0006 | 1.58 | 7.2 | 95 | 1.10 | 360 | 58 | 16.5 | Inventive example |
| 5 | 0.23 | 1.15 | 0.47 | 1.84 | 0.44 | 0.0004 | 1.59 | 6.8 | 78 | 1.05 | 420 | 60 | 18.2 | Inventive example |
| 6 | 0.23 | 1.02 | 0.55 | 1.88 | 0.47 | 0.0018 | 1.49 | 15.6 | 230 | 1.05 | 425 | 56 | 4.5 | Comparative example |
| 7 | 0.22 | 1.02 | 0.51 | 1.78 | 0.52 | 0.0025 | 1.54 | 16.2 | 292 | 1.04 | 418 | 54 | 3.7 | Comparative example |
| 8 | 0.34 | 0.98 | 0.50 | 1.88 | 0.50 | 0.0009 | 1.48 | 8.4 | 157 | 0.97 | 508 | 38 | 13.2 | Comparative example |
| 9 | 0.12 | 1.00 | 0.55 | 1.93 | 0.47 | 0.0009 | 1.47 | 8.6 | 162 | 1.02 | 320 | 64 | 12.5 | Comparative example |
| 10 | 0.21 | 0.52 | 0.55 | 1.87 | 0.38 | 0.0010 | 0.90 | 8.5 | 160 | 1.04 | 408 | 63 | 6.4 | Comparative example |
| 11 | 0.20 | 0.20 | 0.51 | 1.87 | 0.47 | 0.0009 | 0.67 | 8.1 | 148 | 1.04 | 398 | 61 | 5.2 | Comparative example |
| 12 | 0.22 | 0.55 | 0.53 | 1.95 | 0.25 | 0.0008 | 0.80 | 8.5 | 160 | 1.11 | 415 | 60 | 5.8 | Comparative example |
| 13 | 0.23 | 1.15 | 0.47 | 1.84 | 0.44 | 0.0004 | 1.59 | 6.8 | 78 | 0.61 | 420 | 60 | 5.2 | Comparative example |
| 14 | 0.23 | 1.15 | 0.47 | 1.84 | 0.44 | 0.0004 | 1.59 | 6.8 | 78 | 0.81 | 418 | 55 | 18.2 | Inventive example |
| 15 | 0.23 | 1.15 | 0.47 | 1.84 | 0.44 | 0.0004 | 1.59 | 6.8 | 78 | 1.44 | 422 | 52 | 5.8 | Comparative example |

*1toughness: Charpy full size test pieces, notch is 20 mm in R and 3 mm in depth, and test temperature is 20° C.
*2rolling contact fatigue life: Relative values assuming that the SUJ2 life of the conventional steel is 1.

The invention claimed is:

1. A case hardening bearing steel having excellent toughness and an excellent rolling contact fatigue life in intermediate temperature comprising:

C of 0.15 to 0.30 mass percent,
Si of 0.5 to 2.0 mass percent,
Mn of 0.3 to 2.0 mass percent,
Cr of 1.75 to 2.5 mass percent,
Mo of 0.3 to 1.0 mass percent,
and O of not more than 0.0012 mass percent,
in a range where (Si+Mo)≧1.0 mass percent is satisfied, and containing iron and inevitable impurities as remnants; the maximum size of oxide nonmetallic inclusions is not more than 12.5 μm when an examined area is 320 $mm^2$; the number of the oxide nonmetallic inclusions having a diameter of equivalent circle of 3 μm or more is not more than 250 when the examined area is 320 $mm^2$; and a C density of an outer layer is adjusted in a range from 0.7 to 1.2 mass percent by carburization.

2. A ease hardening bearing steel having excellent toughness and an excellent rolling contact fatigue life in intermediate temperature comprising:

C of 0.15 to 0.30 mass percent,
Si of 0.5 to 2.0 mass percent,
Mn of 0.3 to 2.0 mass percent,
Cr of 1.75 to 2.5 mass percent,
Mo of 0.3 to 1.0 mass percent,
and O of not more than 0.00 12 mass percent,
and containing iron and inevitable impurities as remnants;
where (Si+Mo)≧1.0 mass percent is satisfied, the maximum size of oxide nonmetallic inclusions is not more than 12.5 μm when an examined area is 320 $mm^2$, the number of the oxide non-metallic inclusions having a diameter of equivalent circle of 3 μm or more is not more than 250 when the examined area is 320 $mm^2$, and a C density to a depth of 0.5 mm of an outer layer is adjusted in a range from 0.7 to 1.2 mass percent by carburization.

3. A case hardening bearing steel having excellent toughness and an excellent rolling contact fatigue life in intermediate temperature consisting essentially of, C of 0.15 to 0.30 mass percent,
Si of 0.5 to 2.0 mass percent,
Mn of 0.3 to 2.0 mass percent,
Cr of 1.75 to 2.5 mass percent,
Mo of 0.3 to 1.0 mass percent, and O of not more than 0.00 12 mass percent, in a range where (Si+Mo)≧1.0 mass percent is satisfied, and containing iron and inevitable impurities as remnants; the maximum size of oxide nonmetallic inclusions is not more than 12.5 μm when an examined area is 320 $mm^2$; the number of the oxide nonmetallic inclusions having a diameter of equivalent circle of 3 μm or more is not more than 250 when the examined area is 320 $mm^2$; and a C density of an outer layer is adjusted in a range from 0.7 to 1.2 mass percent by carburization.

4. A case hardening bearing steel having excellent toughness and an excellent rolling contact fatigue life in intermediate temperature consisting essentially of, C of 0.15 to 0.30 mass percent, Si of 0.5 to 2.0 mass percent, Mn of 0.3 to 2.0 mass percent, Cr of 1.75 to 2.5 mass percent, Mo of 0.3 to 1.0 mass percent, and O of not more than 0.0012 mass percent, and containing iron and inevitable impurities as remnants;

where (Si+Mo)≧1.0 mass percent is satisfied, the maximum size of oxide nonmetallic inclusions is not more than 12.5 μm when an examined area is 320 $mm^2$,the number of the oxide non-metallic inclusions having a diameter of equivalent circle of 3 μm or more is not more than 250 when the examined area is 320 $mm^2$, and a C density to a depth of 0.5 mm of an outer layer is adjusted in a range from 0.7 to 1.2 mass percent by carburization.

* * * * *

UNITED STATES PATENT AND TRADEMARK OFFICE

CERTIFICATE OF CORRECTION

PATENT NO. : 7,413,704 B2
APPLICATION NO. : 10/502691
DATED : August 19, 2008
INVENTOR(S) : Matsuzaki et al.

It is certified that error appears in the above-identified patent and that said Letters Patent is hereby corrected as shown below:

In Column 4
At lines 35 and 36, please change “proper-ability” to -- probability --.

Signed and Sealed this

Twenty-fourth Day of March, 2009

JOHN DOLL
*Acting Director of the United States Patent and Trademark Office*